US008303472B2

(12) United States Patent
Bowser

(10) Patent No.: US 8,303,472 B2
(45) **Date of Patent: *Nov. 6, 2012**

(54) SHOULDER STRETCHER ASSEMBLY

(75) Inventor: John Bowser, Las Vegas, NV (US)

(73) Assignee: VQ Actioncare, LLC, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/847,056

(22) Filed: Jul. 30, 2010

(65) Prior Publication Data

US 2010/0298106 A1 Nov. 25, 2010

Related U.S. Application Data

(63) Continuation-in-part of application No. 11/490,198, filed on Jul. 20, 2006, now abandoned, which is a continuation-in-part of application No. 11/062,063, filed on Feb. 18, 2005, now Pat. No. 7,322,907, which is a continuation-in-part of application No. 10/783,532, filed on Feb. 21, 2004, now Pat. No. 7,381,168.

(51) Int. Cl.
*A63B 21/02* (2006.01)

(52) U.S. Cl. ..... 482/121; 482/129

(58) Field of Classification Search ..... 482/121, 482/122, 123, 126, 129, 904, 51, 57, 91, 482/93, 142, 148, 55, 62, 124, 125; 601/23, 601/24, 33

See application file for complete search history.

(56) References Cited

U.S. PATENT DOCUMENTS

| | | | | |
|---|---|---|---|---|
| 4,948,119 | A * | 8/1990 | Robertson, Jr. | 482/56 |
| 5,211,614 | A * | 5/1993 | Henes | 482/102 |
| 6,319,179 | B1 * | 11/2001 | Hinds | 482/121 |
| 6,755,770 | B2 * | 6/2004 | Martens | 482/99 |
| 6,790,194 | B1 * | 9/2004 | Katane et al. | 602/36 |
| 7,344,484 | B1 * | 3/2008 | Porcellato | 482/123 |
| 7,429,236 | B2 * | 9/2008 | Dalebout et al. | 482/123 |
| 7,717,824 | B2 * | 5/2010 | Pinto | 482/7 |
| 7,798,946 | B2 * | 9/2010 | Dalebout et al. | 482/142 |
| 7,892,155 | B2 * | 2/2011 | Pearson et al. | 482/121 |
| 2001/0001199 | A1 * | 5/2001 | Sabounjian | 211/202 |
| 2003/0171196 | A1 * | 9/2003 | Cunningham | 482/148 |
| 2004/0097349 | A1 * | 5/2004 | Rogers | 482/91 |

* cited by examiner

*Primary Examiner* — Loan Thanh
*Assistant Examiner* — Tam Nguyen
(74) *Attorney, Agent, or Firm* — Lawrence N. Ginsberg

(57) ABSTRACT

The shoulder stretcher assembly detachably connects to a chair frame of a chair. It includes an elongated support assembly that includes a substantially vertical portion securely supportable adjacent to a rear portion of a chair frame of a chair. An upper portion of the elongated support assembly projects forwardly from the substantially vertical portion so as to extend over the chair. The upper portion includes a pulley assembly attaching element for attaching a pulley assembly for supporting a cable assembly.

13 Claims, 7 Drawing Sheets

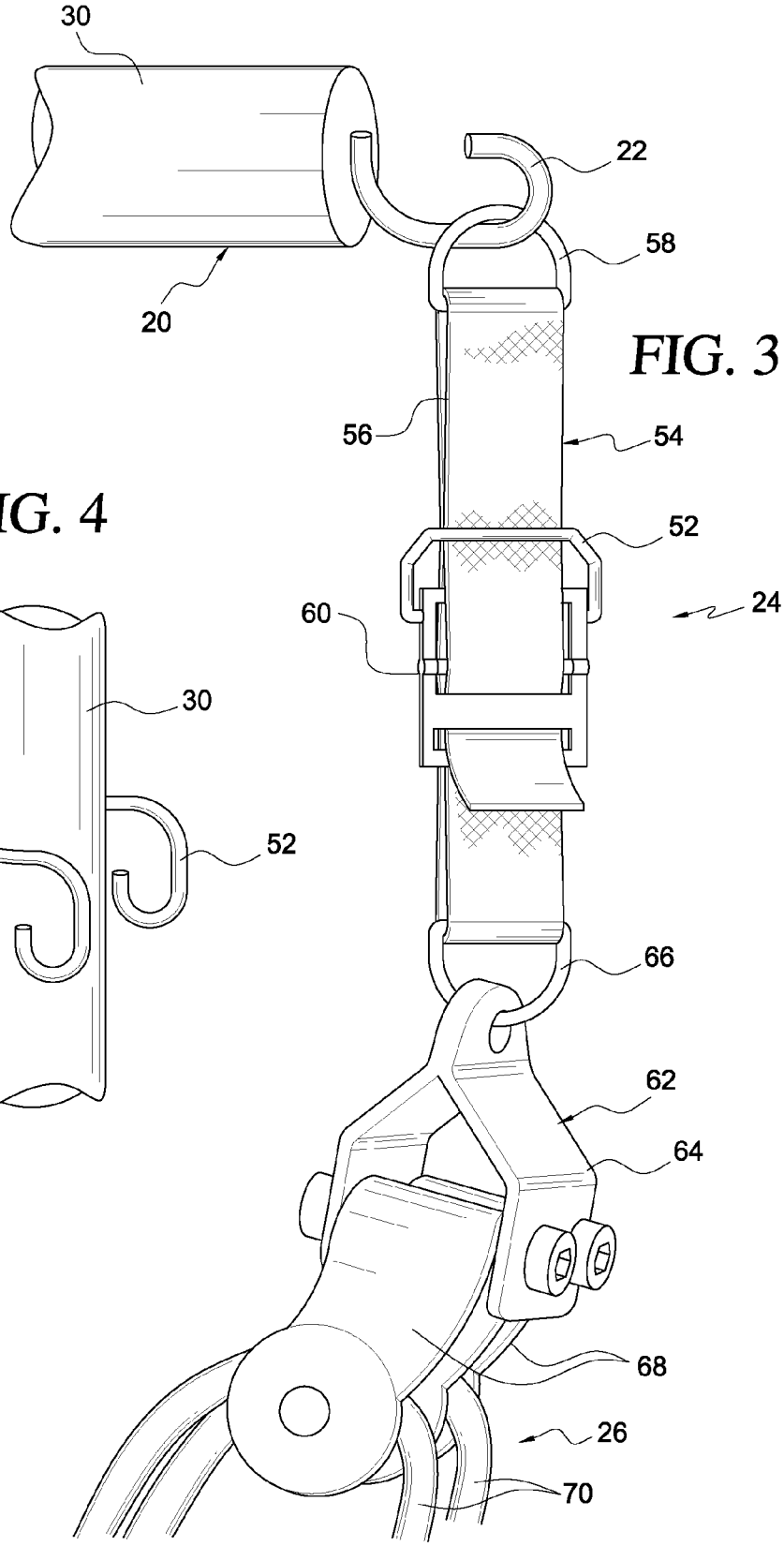
FIG. 3
FIG. 4
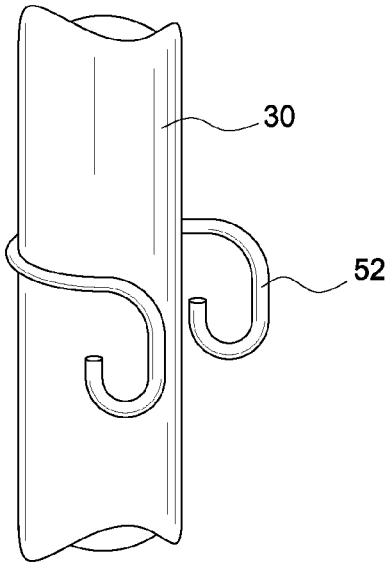

SHOULDER STRETCHER ASSEMBLY

CROSS REFERENCE TO RELATED APPLICATIONS

This is a continuation-in-part of U.S. Ser. No. 11/490,198, entitled "Exercise Cycle Assembly," filed Jul. 20, 2006, now abandoned which is a continuation-in-part of U.S. Ser. No. 11/062,063, entitled "Exercise System Using Exercise Resistance Cables," filed Feb. 18, 2005 now U.S. Pat. No. 7,322,907, which is a continuation-in-part of U.S. Ser. No. 10/783,532, entitled "Exercise System Using Exercise Resistance Cables," filed Feb. 21, 2004, now U.S. Pat. No. 7,381,168.

BACKGROUND OF THE INVENTION

1. Field of the Invention

The present invention relates to exercise and rehabilitation devices and systems and more particularly to an exercise/rehabilitation system that utilizes a shoulder stretcher assembly that connects to a support structure.

2. Description of the Related Art

The use of resistance cables for exercising is well known in the prior art. There are a multitude of different exercise systems and devices that have been previously disclosed or are currently in the market to supply the increasing demand for physical fitness. Many of these utilize resistance cables. For example, as far back as 1902, U.S. Pat. No. 704,840, issued to J. C. Korth et disclosed the use of an exercising machine employing elastic cords. U.S. Pat. No. 3,606,321, issued to N. D. Macoulis, discloses the use of elastic cords and a pole. U.S. Pat. No. 3,843,119, issued to R. P. Davis, discloses the use of a machine for exercising the arm muscles while the user stands upon a base.

U.S. Pat. No. 4,019,734, issued to W. Lee et al, discloses an elastic resistance type exercising device having a single length of latex rubber surgical tubing whose two ends are formed into size handle loops by the use of leather fasteners. The handle loops are sleeved with vinyl tubing, and plugs are inserted in each of the open ends of tubing, that have twice passed through the fasteners to form the loops, to prevent the tubing from being pulled out of the fasteners. A user grasps the handle loops or secures them about his ankles and pulls against the elastic resistance. Two additional flexible sleeves are slidably mounted over the portion of the elastic tubing between the fasteners.

U.S. Pat. No. 3,677,543, issued to J. H. Richardson, discloses a pull type exercising device including a single piece of elastic tubing with loops formed at the respective ends of the tubing by s-shaped hooks that receive folded ends of the tubing. On each looped portion there is a sleeve. A slideable ring with an anchoring attachment is mounted on a tubular member. A user inserts an arm or leg in the loops and pulls his arm or leg and pulls on the anchored tubular member.

U.S. Pat. No. 6,508,749, issued to R. L. Broadwater, discloses a portable exercise device that includes an elastic cord with two ends. Each of the ends of the cord is received into opposite sides of a coupling. A clamp element is provided around a portion of the coupling. The clamp element compresses the coupling around the elastic cord to hold the cord in place inside the coupling. A handle may be provided around the coupling. The handle may be made from a resilient material so that the hand of the user may squeeze it. Additionally, end plugs may be provided for the handle to prevent the handle from slipping off the coupling.

U.S. Pat. No. 4,251,071, issued to Craig D. Norton, discloses an exercising device that comprises an elongated elastic cord with a foot-receiving loop formed at each end and a hollow hand grip with an axial bore extending from end to end with a longitudinally extending split permitting one or two lengths of the elastic rope to be inserted into the bore. The hand grip may be squeezed by the hand for causing the wall of the bore to frictionally grip the rope. The hand muscles are exercised by this squeezing action on the hand grip and the arm and shoulder muscles are exercised when the hand grip pulls on the rope to elongate it.

U.S. Pat. No. 4,852,874, issued to C. G. Sleichter, III et al, disclose an exercise device that includes an elastic loop having free ends spliced together, generally tubular handles disposed in diametrically opposed relation to one another on the loop and an elastic retainer sleeve surrounding intermediate portions of the loop between the handles. The device is conformable for use in performing a wide variety of exercises and for performing a selected number of repetitions of each exercise by grasping the handles and stretching against the resistance load of the loop and the retainer means. The handles can be grasped either by the hands or by a combination of hands and feet to perform various exercises or may be grasped between the feet or ankle portions to perform other exercises. In modified forms of the invention, one of the handles is made rigid so as to simulate a racquet or golf club handle to be used in practicing forehand and backhand strokes or to simulate the golf swing. The exercises may be performed effectively in either the standing, sitting or fully prone position. Other modified forms of invention include an anchor strap to facilitate practicing of the golf swing and a splice for joining together free ends of the loop into a unitary member.

U.S. Pat. No. 4,733,862, issued to J. V. Miller discloses an elastic resistance exerciser comprising an elongated elastic member having a loop formed at each end, a tubular handle slidably fit onto each loop of the elastic member, and a self-locking slider having three holes; with the elastic member slidably threaded through two of the holes and terminating the end of each loop in the third hole of each slider; the slider being adjustable along the elastic member, whereby the size of the loop may be varied by moving the slider with no tension on the loop, but self-locking by the application of tension to the loop. A preferred embodiment provides a band of flexible material attached approximately to the center of the length of an elastic member having more than one elastic element.

The above-mentioned patents each use elastic cable which functions as a resistance tool for exercising the body. In some cases the elastic/rubber cable is the only thing necessary to achieve the complete workout. In other cases a secondary product, such as a door, a handle or some sort of stationary device is required in order to use the product as designed.

There are a variety of patents that disclose exercise systems related to chairs. For example, U.S. Pat. No. 5,470,298, issued to J. L. Curtis; U.S. Pat. No. 5,417,643, issued to M. D. Taylor; U.S. Pat. No. 5,387,171, issued to M. E. Casey; U.S. Pat. No. 5,080,353, issued to L. Teach; U.S. Pat. No. 5,044,633, issued to B. A. Rice; U.S. Pat. No. 4,921,247, issued to J. F. Sterling; U.S. Pat. No. 4,838,547, issued to J. F. Sterling; U.S. Pat. No. 4,720,099, issued to R. B. Carlson; U.S. Pat. No. 1,279,120, issued to J. H. Kellogg; U.S. Publicn No. 2002/0173412 to K. W. Stearns; and, U.S. Publicn No. 2002/0077228 to R. W. McBride each disclose chair-related related exercise devices which have generally complicated designs.

U.S. Pat. No. 4,913,423, issued to M. R. Farran, discloses a furniture article, such as a seating article, for residential and office use that includes a frame housing, one or more exercise apparatus that are located in the armrest, the back and the seating base. The frame is selectively covered to provide the seating article with the appearance of a conventional furniture article used in the home or office. Each exercise apparatus employs a cable extending through the covering to communicate a source of resistive force from within the frame to a user outside of the frame. On the end of the cable outside of the covering is a handle or a foot stirrup by which the user pulls the cable out of the seating article. A cover conceals the handle or foot stirrup as well as the end of the cable while the exercise aspects of the furniture article are not being utilized. As in the other patents, discussed above, the Farran system is somewhat complicated. Furthermore, it is non-mobile and is limited in the amount of workout routines allotted.

U.S. Pat. No. 5,362,296, issued to L. Wang et al., discloses a chair mounting exercising unit includes two swinging arms having a bottom end fastened to either end of a substantially U-shaped locating rod being fixed to the back of a chair by a knob controlled lock device and a slotted side extension plate in the middle at an outer side movably hung on a screw bolt at either end of a horizontal frame on the back of the chair and a top end coupled with a pulley wheel assembly, and two elastic pull ropes respectively inserted through either pulley wheel assembly and fastened to either swinging arm and an opposite end coupled with a handle. With the increasing population of elderly persons and their desire for increased exercise there is a concomitant growing need for exercise equipment that the elderly can easily and efficiently use. The '296 patent system has two swinging arms each having a bottom end connected to either end of the locating rod and attached to either locating wheel. A mobile/moving system is not generally preferred for use with the elderly and is somewhat complicated. Positioning of the swinging arms requires time and labor. The present invention, as will be disclosed below, is designed for specific exercises and is excellent for users who have limited range of movement. It allows for a very stable environment minimizing movement in the setup process and eliminating the need for pulley arms. The present invention also allows the user to change cables without having to get up from the chair since all of the cable connections are set up on the sides of the chair versus the cables connections being on the back of the chair as disclosed in the '296 patent.

U.S. Pat. No. 5,674,167, issued to G. D. Piaget et al., discloses a strength training exercise apparatus includes a frame having an upright back rest, and a horizontal seat, and further includes opposing arm members pivotally mounted to the back rest. The arm members are movable through an arcuate range of motion, and include locking pins for selectively locking the arm members in desired angular positions. The apparatus still further includes a resistance assembly consisting of a fixed anchor mounted on the frame, a movable anchor which is movable relative to the fixed anchor, and a plurality of elastomeric resistance cords releasably secured between the movable anchor and the fixed anchor to provide resistance to movement of the movable anchor. A pull line is mounted on guide pulleys along the length of the arm members, and is received in association with the movable anchor whereby outward movement of the pull line with respect to the arm members causes movement of the movable anchor with respect to the fixed anchor. The exercise apparatus further consists of a leg member pivotally mounted to the seat, and a second resistance assembly including a second movable anchor coupled to the leg member, and a second plurality of elastomeric resistance cords secured between the fixed anchor and the second movable anchor for providing resistance to pivotal movement of the leg member. Seniors need ease of use when it involves getting on and off of the chair. The '167 patent system has opposing arm members pivotally mounted to the back rest. The arm members are movable through an arcuate range of motion and include locking pins for selectively locking the arm members in desired angular positions. While using the '167 device the user typically needs to get off of the chair in order to make the rear and lower connections. As noted above and as will be disclosed below, the exercise chair of the present invention allows the user to remain seated to make the necessary connections on the side of the chair.

U.S. Pat. No. 5,899,836, issued to P. Chen, discloses an exerciser includes a foot support secured in front of a base. A lever has a lower portion pivotally coupled to the base and has a bracket and a seat cushion pivotally secured on tops for allowing the seat cushion to be moved upward and downward. A tube is secured to the bracket for supporting one or more pulleys. The base has one or more pulleys secured to the front and the rear portions. One or more resilient members are engaged with the pulleys. A handle may be secured to the resilient member for conducting pulling exercises. The tube and a pulley may be moved upward and downward in concert with the seat cushion. The present invention does not have a secured foot rest and does not require the use of levers. The '836 design requires many steps for exercise setup and disassembly.

U.S. Pat. No. 6,117,056, issued to T. F. Cataldi, Jr. et al., discloses an exercise device attachable to the seat portion of a chair to resist forces applied in performing isotonic exercises. The device includes a strap securable to a chair and a seat pad positionable on the strap for supporting an exerciser and has D-rings secured to the strap and the seat pad for attachment of an elastic band for performing arm isotonic exercises with a hand band attachment. The device also includes a front flap securable at one end between the seat pad and strap and securable at an opposite end to a downwardly forward portion of the chair for performing leg isotonic exercises with an attached elastic band and an ankle strap attachment.

U.S. Pat. No. 6,159,133, issued to R. C. Shugg, discloses a seat mounted workout station system is provided including a seating assembly having a seat portion and a back portion. Also included is a frame mounted on a rear surface of the back portion of the seating assembly. Next provided is a plurality of tension members connected to the frame and further connected to cables which are routed through the frame via pulleys. Hand grips are connected to the cables for being gripped by a user.

As noted above, with the increasing population of elderly persons and their desire for increased exercise there is an associated growing need for exercise equipment that the elderly can easily and efficiently use. This population has increasing needs for shoulder stretching equipment.

Additionally, people of any age suffer from various debilitating shoulder conditions, such frozen shoulder syndrome, bursitits, etc. As will be disclosed below, the present invention satisfies various rehabilitation/exercise needs.

SUMMARY OF THE INVENTION

The present invention is a shoulder stretcher assembly that detachably connects to a chair frame of a chair. The shoulder stretcher assembly includes an elongated support assembly that includes a substantially vertical portion securely supportable adjacent to a rear portion of a chair frame of a chair. An upper portion of the elongated support assembly projects forwardly from the substantially vertical portion so as to extend over the chair. The upper portion includes a pulley assembly attaching element for attaching a pulley assembly for supporting a cable assembly.

In one broad aspect, the elongated support assembly includes a lower straight support tube including a main section of the substantially vertical portion. An upper support tube has a straight lower part thereof and a curved upper part thereof. The straight lower part includes another section of the substantially vertical portion. The curved upper part includes the upper portion of the elongated support assembly. A tube connector bar couples the lower straight tube with the upper support tube. The tube connector bar has a central spacing ridge for spacing the lower straight support tube from the upper support tube and allowing relative rotation therebetween.

In a broad aspect, the elongated support assembly comprises a lower mounting bracket assembly securely attachable to a lower section of the rear portion of the chair frame. The chair frame is of a type having a lower section that includes a horizontal crossbar connecting two rear legs of the chair. The lower mounting bracket assembly comprises a lower mounting bracket having an opening for accepting and for securely supporting a lower end of the substantially vertical portion. A bottom plate matingly engages the lower mounting bracket for securing the lower mounting bracket assembly to the horizontal crossbar. An upper mounting bracket assembly is securely attachable to an upper section of the rear portion of the chair frame, the upper mounting bracket assembly securely supports an intermediate section of the substantially vertical portion. The upper section of the chair is of a type having a center column near the top of a backrest of the chair. The upper mounting bracket assembly includes an upper mounting bracket having an opening for accepting and for securely supporting the intermediate section of the substantially vertical portion. An upper bracket plate matingly engages the upper mounting bracket for securing the upper mounting bracket assembly to the center column.

In a preferred embodiment, the pulley assembly utilized includes a support assembly attachment element for removably attaching the pulley assembly to the pulley assembly attaching element; and, a pulley housing attached to the support assembly attachment element for supporting a cable assembly. The pulley housing comprises a pulley bracket attached to the pulley assembly attaching element; and, a pair of pulleys attached to swivel in an orthogonal direction from a plane of the pulley bracket.

The present invention is particularly useful for people of any age suffering from any type of shoulder injury, frozen shoulder syndrome, bursitis, and a variety of other shoulder illness or limitations.

The systems of the present invention are particularly advantageous for use with elderly persons. The present invention is easy to use, particularly for the elderly, because, assuming that the chairs are set up, the person merely picks up the desired cables and brings those cables to his or her exercise chair, attaches the cable assembly and is ready to work out.

Similarly, the elongated support assembly can easily be connected to the exercise/rehabilitation chair.

Foldable chairs may be utilized that can be stored or kept in a variety of places such as in the home, hotels, retirement communities, health clubs, and physical therapy centers. Use of such foldable chairs provides a very mobile environment.

The present exercise system provides strength training without the stress of a pre-designed rigid machine. A person can take cables, connect them to the assembly and exercise in accordance with his body height and size.

However, the shoulder stretcher assembly may be integrated into a universal gym system and utilized with a variety of exercises.

Use of the present invention has several advantages over the prior art. The assembly can be connected to the chair and moved to any position in the house/facility to provide rehabilitiation/exercise as desired. For exercise use, it allows the user to easily change resistance levels and adjust resistant lengths. The present inventive concepts provide safe, low impact exercise solutions that are easy to use and make the user feel better. Use with the folding resistance chair and shoulder stretcher assembly provides a very convenient home exercise system. The shoulder stretcher assembly allows the user to perform a full shoulder workout from a safe, comfortable seated position. When seated, balance and stability is maintained as the shoulders are exercised. The swiveling enabled by the tube connector bar ensures that the cable remains at the best angle for each exercise. The unique cable system offers a wide range of shoulder exercises and provides resistance without use of heavy weights. When utilizing the cables with the resistance chair, the user is provided with a safe, comfortable, secure and well rounded exercise routine.

The resistance chair has a pair of front legs that are preferably each forwardly curved at an intermediate region thereof to enhance weight distribution for optimizing stability. This weight distribution design ("WDD") provides a secure and safe structure particularly advantageous utilizing recommended balance bar exercise routines.

BRIEF DESCRIPTION OF THE DRAWINGS

FIG. 3 is an enlarged perspective view of a pulley assembly of the present invention.

FIG. 4 is an enlarged perspective view of a cable anchor bracket of the present invention.

DETAILED DESCRIPTION OF THE INVENTION

Figure 1:
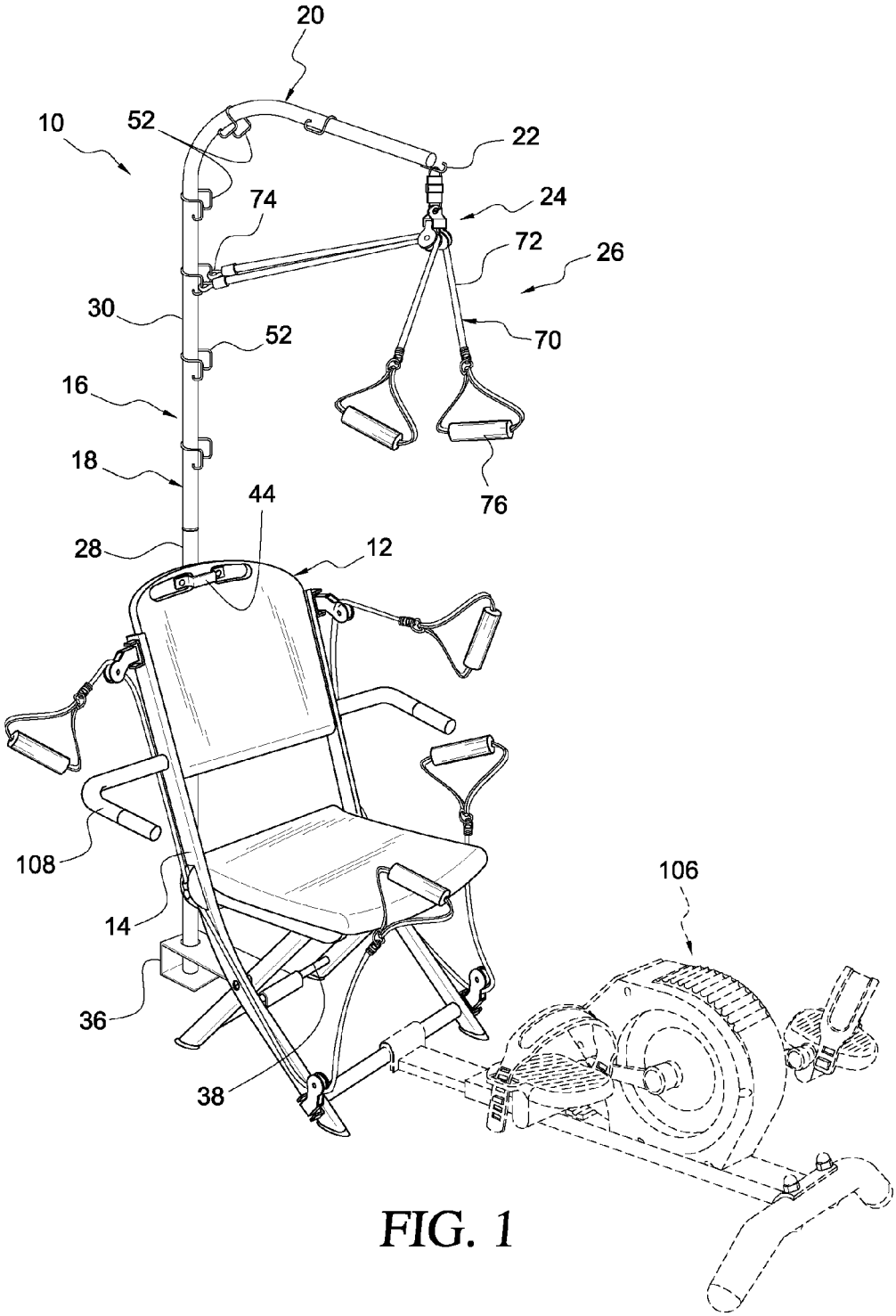
FIG. 1 is a perspective view of a first embodiment of the shoulder stretcher assembly of the present invention connected to an exercise chair.

Referring now to the drawings and the characters of reference marked thereon, FIG. 1 illustrates a first embodiment of the shoulder stretcher assembly of the present invention, designated generally as 10, which can be used in conjunction with a support structure, preferably a chair 12. The shoulder stretcher assembly 10 detachably connects to the chair frame 14 of the chair 12. It includes an elongated support assembly 16 having a substantially vertical portion 18 securely supportable adjacent to a rear portion of the chair frame 14; and, an upper portion 20 projecting forwardly from the substantially vertical portion so as to extend over the chair. The upper portion includes a pulley assembly attaching element 22 for attaching a pulley assembly 24 for supporting a cable assembly 26.

Figure 2:
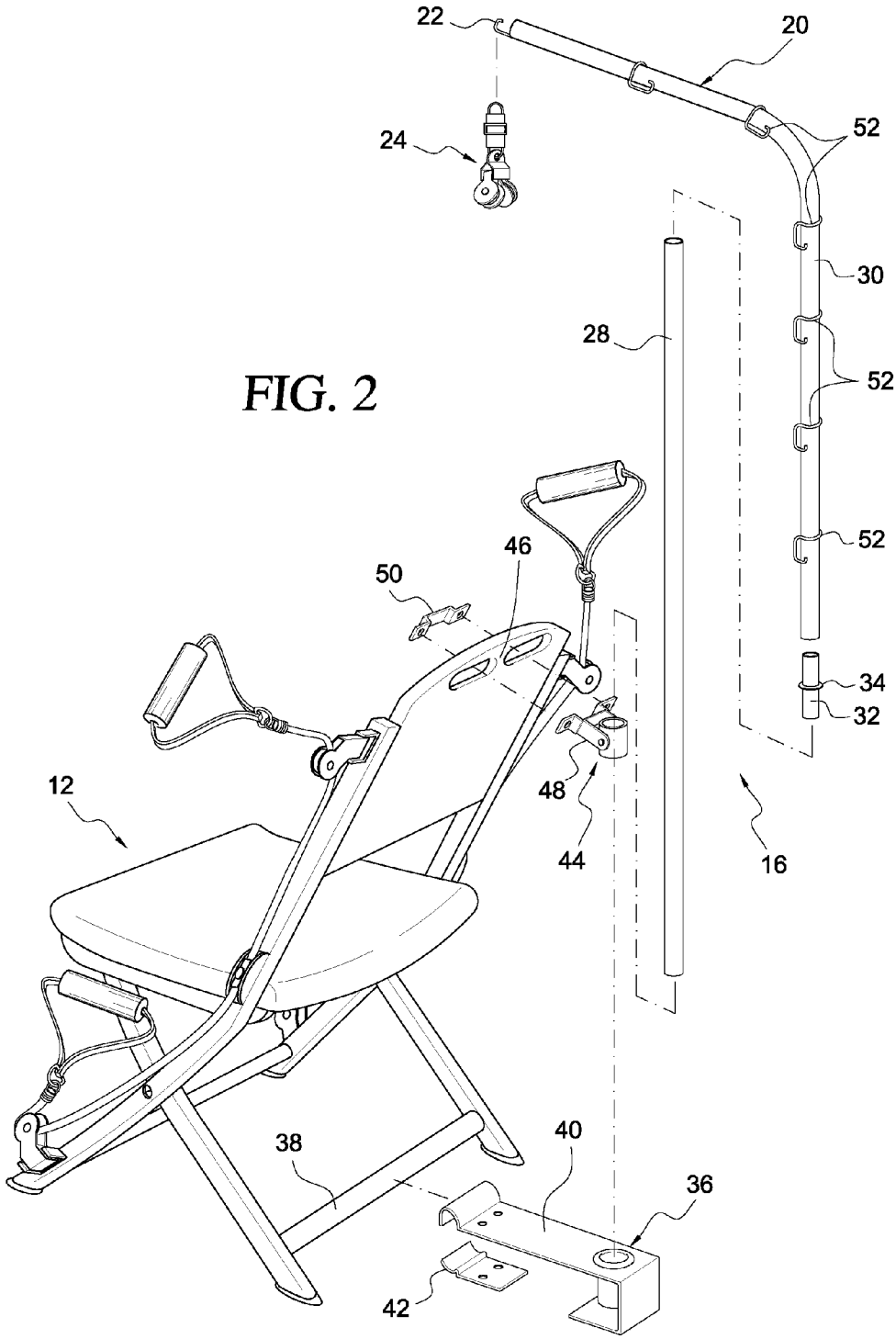
FIG. 2 is a rear perspective view of the shoulder stretcher assembly of the first embodiment of the present invention.

As best seen in FIG. 2, in this preferred embodiment, the elongated support assembly 16 includes a lower straight support tube 28 that comprises a main section of the substantially vertical portion 18; and, an upper support tube 30. The upper tube 30 has a straight lower part thereof and a curved upper part thereof. The straight lower part comprises another section of the substantially vertical portion 18. The curved upper part comprises the upper portion of the elongated support assembly 16. A tube connector bar 32 couples the lower straight tube 28 with the upper support tube 30. The tube connector bar 32 has a central spacing ridge 34 for spacing the lower straight support tube 28 from the upper support tube 30 and allowing relative rotation therebetween. This allows the upper support tube 30 to swivel providing a natural kinetic movement. The user's arm can proceed substantially straight up over his shoulder.

The elongated support assembly 16 includes a lower mounting bracket assembly 36 securely attachable to a lower section of the rear portion of the chair frame 14. The lower section includes a horizontal crossbar 38 connecting two rear legs of the chair. The lower mounting bracket assembly 36 includes a lower mounting bracket 40 having an opening for accepting and for securely supporting a lower end of the substantially vertical portion 18; and a bottom plate 42 for matingly engaging the lower mounting bracket 40 for securing the lower mounting bracket assembly 36 to the horizontal crossbar 38. Two bolts and nuts may be used for attachment. The lower mounting bracket assembly 36 should be centered in the middle of the crossbar 38.

An upper mounting bracket assembly 44 is securely attachable to an upper section of the rear portion of the chair frame 14. The upper mounting bracket assembly 44 securely supports an intermediate section of the substantially vertical portion 18. The upper section includes a center column 46 near the top of a backrest of the chair 12. The upper mounting bracket assembly 44 includes an upper mounting bracket 48 having an opening for accepting and for securely supporting the intermediate section of the substantially vertical portion 18. An upper bracket plate 50 matingly engages the upper mounting bracket 48 and secures the upper mounting bracket assembly 44 to the center column 46. Suitable mounting bolts may be used.

When the lower mounting bracket assembly 36 and the upper mounting bracket assembly 44 are secured, the lower support tube 28 can be slid through the upper mounting bracket 48 and down through the hole in the lower mounting bracket 40. The tube connector bar 32 is installed. Then, the upper support tube 30 is slid down into the tube connector bar 32.

As best seen in FIG. 4, at least one cable anchor bracket 52, and preferably a number of spaced anchor brackets 52 are securely attached to the vertical portion 18 or the upper portion 20 for securing the cable assembly 26.

Referring now to FIG. 3, the upper portion 20 includes a pulley assembly attaching element 22 for attaching a pulley assembly 24. The pulley assembly attaching element 22 is preferably a pulley hook that is welded to the end of the upper tube 30. The pulley assembly 24 preferably includes a support assembly attachment element 54 for removably attaching the pulley assembly 24 to the pulley assembly attaching element 22. The support assembly attachment element 54 preferably includes a nylon strap 56 attachable to the pulley assembly attaching element 22 (via a D-ring 58) and a buckle 60 attached to the nylon strap 56 for adjusting the length of the nylon strap 56.

Figure 5:
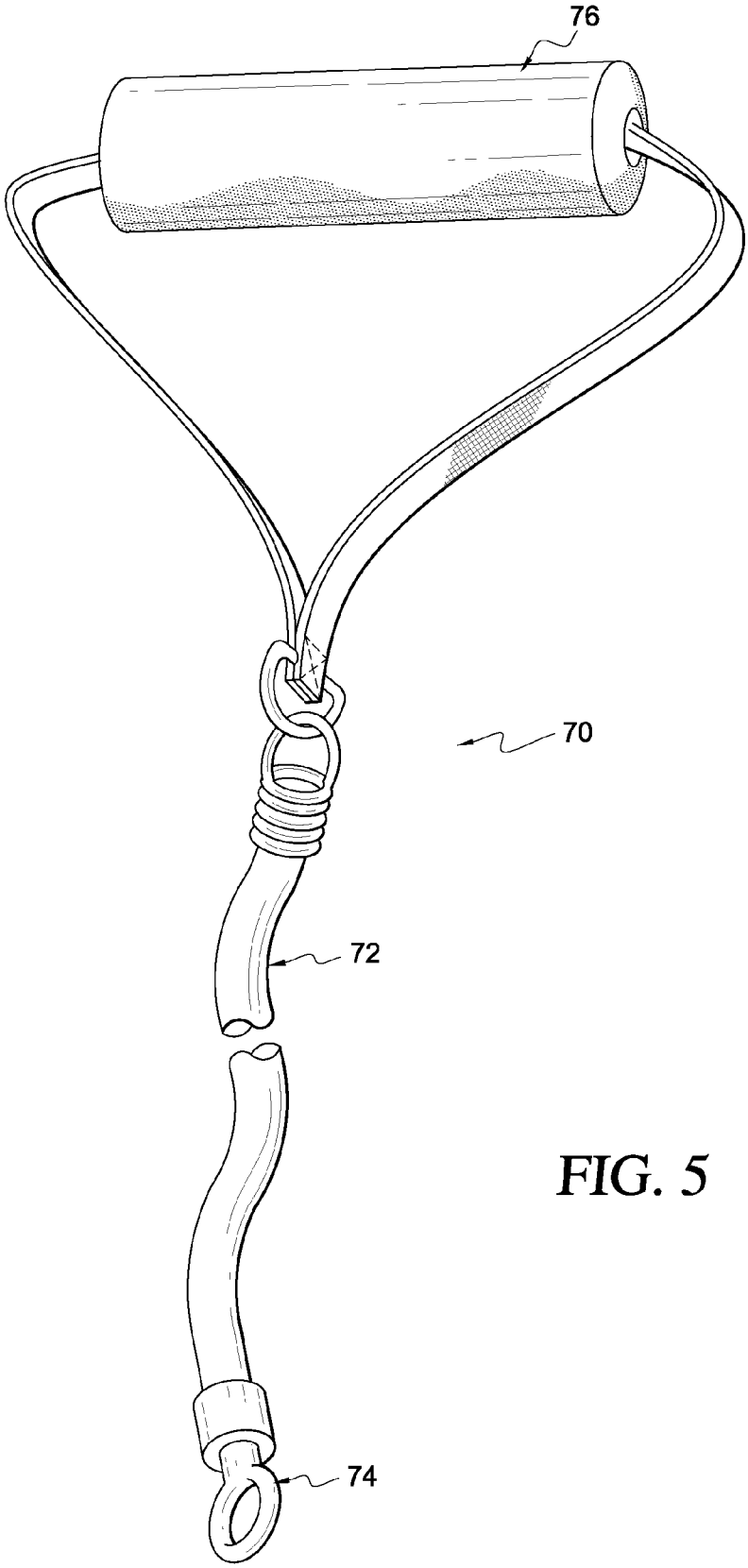
FIG. 5 is a perspective view of a preferred embodiment of a cable assembly utilized with the present invention.

A pulley housing 62 is attached to the support assembly attachment element 54 for supporting the cable assembly 26. The pulley housing 62 includes a pulley bracket 64 attached to the support assembly attachment element 54 (via a D-ring 66) and a pair of pulleys 68 attached to swivel in an orthogonal direction from a plane of the pulley bracket 64. The pulley bracket 64 is preferably formed of steel. The pulleys 68 are preferably designed to accommodate cable assemblies of the type disclosed and claimed in applicant's co-pending patent application, U.S. Ser. No. 11/062,063, entitled "Exercise System Using Exercise Resistance Cables," which is incorporated herein in its entirety. Referring best to FIG. 5, each cable 70 of the cable assembly 26, i.e. each exercise resistance cable apparatus, includes an elastic exercise resistance cable 72. A cable anchor ring, i.e. cable attaching element 74, is securely connected to a first end of the elastic exercise resistance cable 72. A handgrip, i.e. handle 76, is connected to a second end of the elastic exercise resistance cable. During use the elastic exercise resistance cable is directed through an activity bay of the pulley assembly 24 and ultimately attached, via the cable anchor ring 74, to a cable anchor bracket 52.

Figure 6:
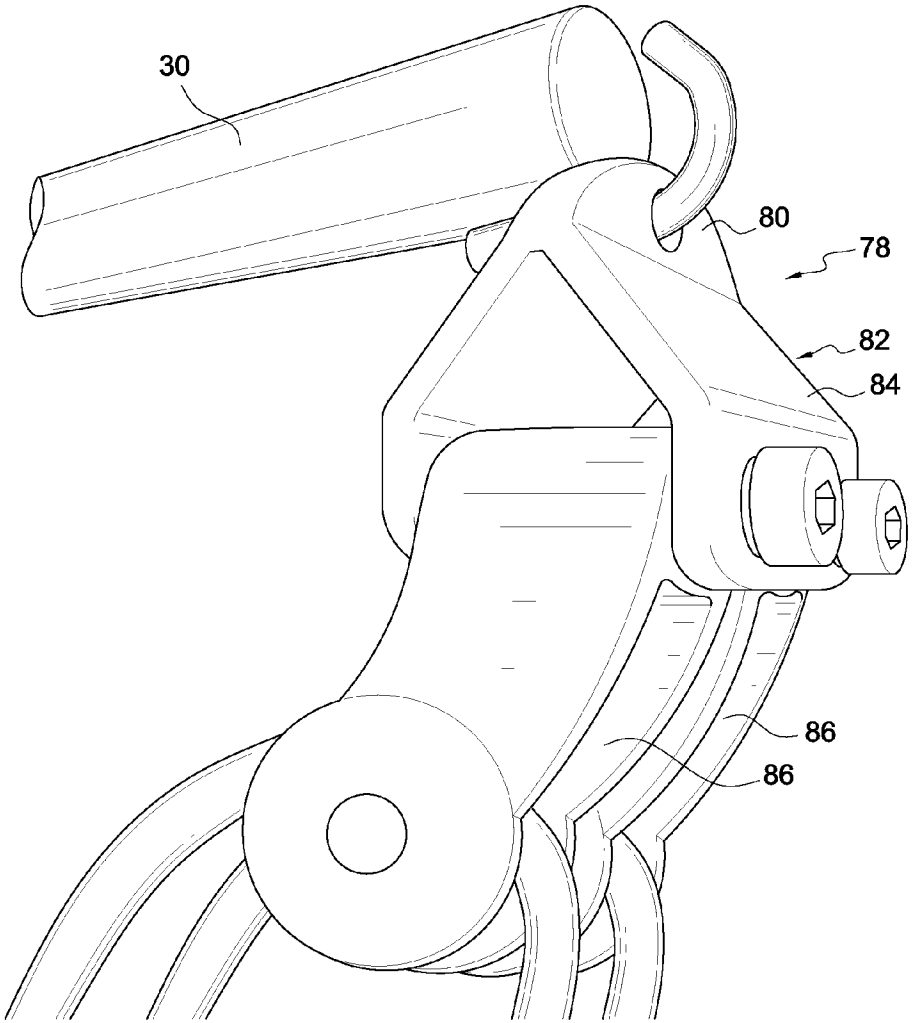
FIG. 6 is a perspective view of an alternate shoulder stretcher assembly utilizing a pulley assembly that is not adjustable.

Referring now to FIG. 6, an alternate pulley assembly is illustrated, designated generally as 78. In this instance the support assembly attachment element 80 still removably attaches the pulley assembly 78 to the pulley assembly attaching element, i.e. in this case via openings therein; however, there is no adjustability feature. The pulley housing 82 and support assembly attachment element 80 are an integral unit. The pulley housing 82 includes a pulley bracket 84 integrally attached to the support assembly attaching element 80. A pair of pulleys 86 are attached to swivel in an orthogonal direction from a plane of the pulley bracket 84.

Figure 7:
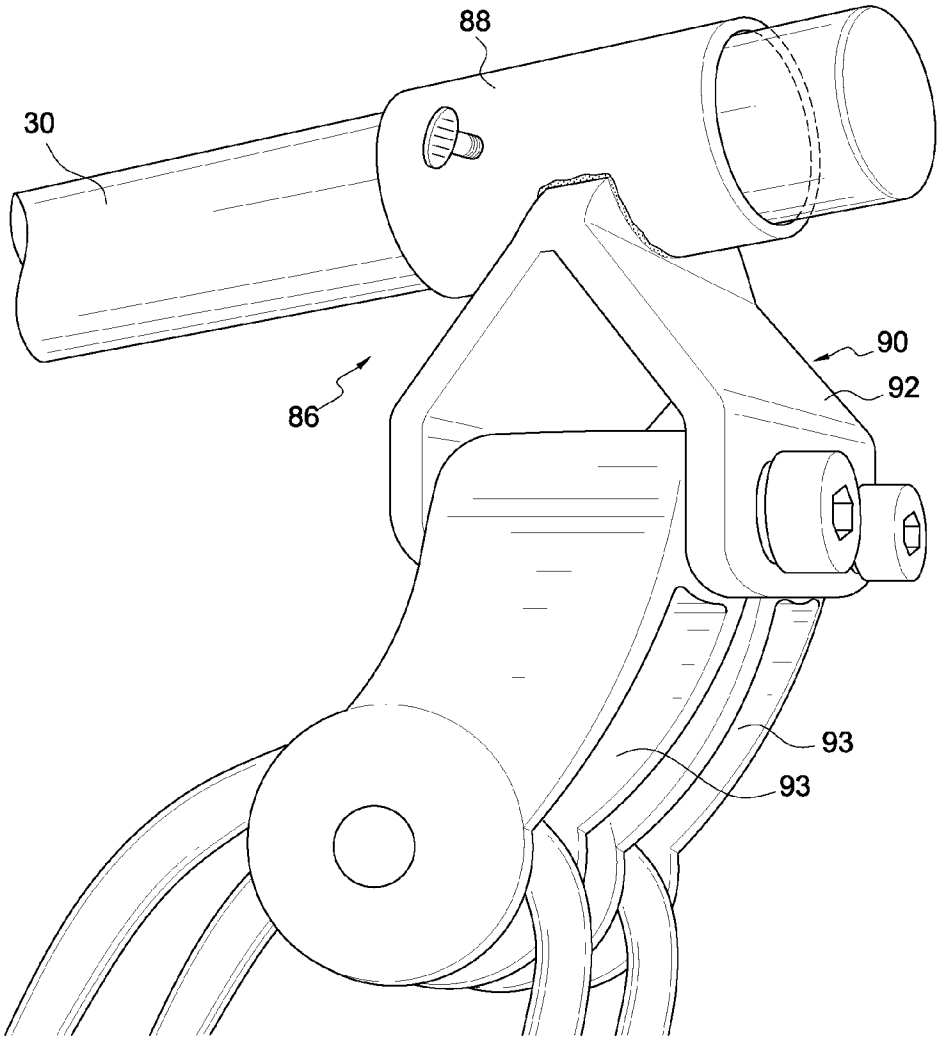
FIG. 7 is perspective view of another embodiment of the shoulder stretcher assembly in which a sleeve is used to fit over the end of the upper portion of the elongated support assembly.

Referring now to FIG. 7, another alternate pulley assembly is illustrated, designated generally as 86. As in the other embodiments, the support assembly attachment element 88 removably attaches the pulley assembly 78 to the pulley assembly attaching element. In this case this is accomplished via a sleeve 88 that slides over the end of the upper tube 30. Again, there is no adjustability feature. The pulley housing 90 and support assembly attachment element 88 are an integral unit, preferably welded together. The pulley housing 90 includes a pulley bracket 92 integrally attached to the pulley assembly attaching element 88. A pair of pulleys 93 are attached to swivel in an orthogonal direction from a plane of the pulley bracket 84.

Figure 8:
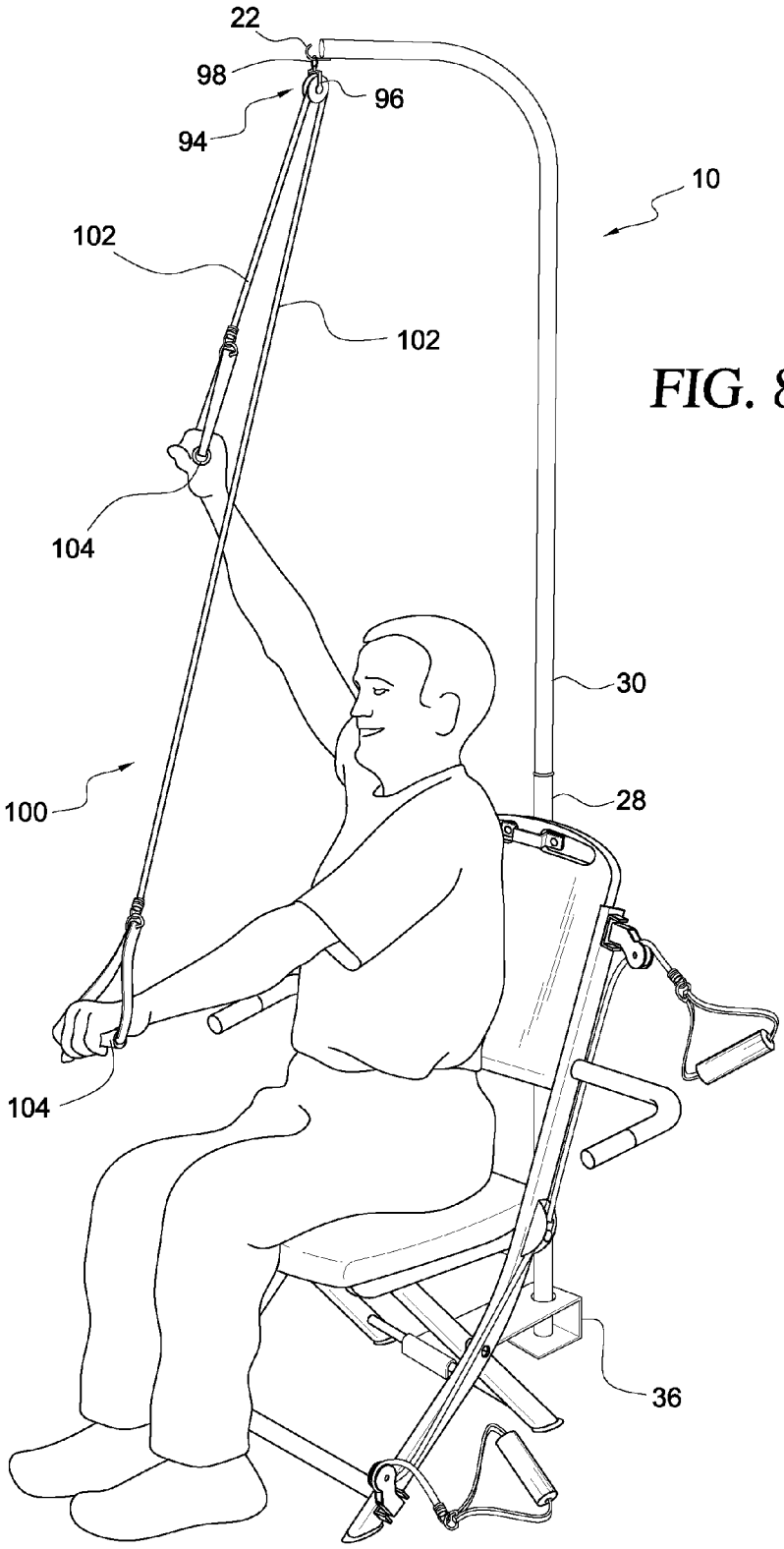
FIG. 8 is a perspective view of an alternate shoulder stretcher assembly utilizing a pulley assembly that is a combined cable/pulley assembly.

Referring now to FIG. 8, another alternate pulley assembly is illustrated, designated generally as 94. In this embodiment, the pulley assembly 94 is a combined cable/pulley assembly 94 that includes a pulley housing 96 including a support assembly attachment element 98 for removably attaching the pulley housing 96 to the pulley assembly attaching element 22. The cable assembly 100 of the pulley assembly 94 includes a cable 102 operatively associated with the pulley housing 96; and, a pair of handles 104, each handle 104 secured at a respective end of the cable 102.

Referring again to FIG. 1, it can be seen that the present invention cooperates very well with other inventions disclosed and claimed by the present applicant. FIG. 1 shows the use of an exercise cycle assembly, designated in phantom lines generally as 106. This exercise cycle assembly is of the type disclosed and claimed in applicant's co-pending patent application, U.S. Ser. No. 11/490,198, entitled "Exercise Cycle Assembly," which is incorporated herein in its entirety. To aid in the utilization of these various systems associated with the chair 12, handlebars 108 may be provided.

Additional applications of this technology are disclosed in applicant's previous patent applications—including a universal gym. The universal gym exercise system includes a main frame and a number of exercise components associated with the main frame. One of these components includes a support structure, i.e. exercise chair 12, having activity bays. Other components of the exercise system may include a stepper assembly, a handle assembly, an ergometer, and a step rotator assembly. There is a wide variety of exercise equipment that can be connected to the frame, for example, a rowing machine or elliptical machine.

Generally, cables used with the shoulder stretcher for rehabilitation purposes are not elastic. Typically, a substantially non-stretchable material such as nylon is used. However, alternatively, for exercise applications, the cables may be elastic. The resistance of the cables used with the chair and shoulder stretcher is tied to the thickness or grade of materials used for the cable. Preferably, a varying degree of cables are implemented for use with this invention, as it applies to exercise applications. They may be categorized, for example, in terms of light, medium and heavy resistance. Or, they may be more particularly referred to relative to their resistance in pounds, i.e., Light—5 to 15 lbs of resistance, Medium—16 to 30 lbs of resistance. Heavy—31 to 45 lbs of resistance. The elastic exercise resistance cables are preferably formed of rubber; however, they may be formed of other suitable stretchable materials.

A stepper and/or back support assembly (not shown) may be utilized with the resistance chair 12.

The front legs of the chair frame 14 are each forwardly curved at an intermediate region thereof to enhance weight distribution for optimizing stability. This weight distribution design ("WDD") provides a secure and safe embodiment of the structure while utilizing recommended balance bar exercise routines. The need for enhanced stability is imperative for exercise/rehabilitation equipment intended for senior use. Generally, senior citizens may not have the balancing capabilities that younger persons have. Furthermore, they are more susceptible to injury from a fall.

Obviously, many modifications and variations of the present invention are possible in light of the above teachings. It is, therefore, to be understood that within the scope of the appended claims, the invention may be practiced otherwise than as specifically described. For example, although this invention has been described relative to its use with an exercise chair other applications are possible such as utilizing these inventive concepts with a flat support structure that would be placed underneath a person who is bed ridden or does not have use of their legs. This embodiment would slide under the user and allow them, from a laying down position, to use the system as if they were sitting in the chair.

What is claimed is:

1. A shoulder stretcher assembly, comprising:
a) an exercise chair having a chair frame;
b) an elongated support assembly, comprising:
i) a substantially vertical portion securely attachable to a rear portion of said chair frame of said chair; and,
ii) an upper portion projecting forwardly from said substantially vertical portion so as to extend over said chair, said upper portion including a pulley assembly attaching element for attaching a pulley assembly for supporting a cable assembly; and,
c) a pulley assembly, comprising:
i) a support assembly attachment element for removably attaching said pulley assembly to said pulley assembly attaching element; and,
ii) a pulley housing attached to said support assembly attachment element for supporting a cable assembly
wherein said elongated support assembly includes at least one cable anchor bracket securely attached to said vertical portion or said upper portion.

2. The shoulder stretcher assembly of claim 1 wherein said pulley housing comprises:
i) a pulley bracket attached to said pulley assembly attaching element; and,
ii) a pair of pulleys attached to swivel in an orthogonal direction from a plane of said pulley bracket.

3. The shoulder stretcher assembly of claim 1 wherein said support assembly attachment element comprises:
i) a nylon strap attachable to said pulley assembly attaching element; and,
ii) a buckle attached to said nylon strap for adjusting the length of said nylon strap.

4. A shoulder stretcher assembly, comprising:
a) an exercise chair having a chair frame;
b) an elongated support assembly, comprising:
i) a substantially vertical portion securely attachable to a rear portion of said chair frame of said chair; and,
ii) an upper portion projecting forwardly from said substantially vertical portion so as to extend over said chair, said upper portion including a pulley assembly attaching element for attaching a pulley assembly for supporting a cable assembly;
c) a pulley assembly, comprising:
i) a support assembly attachment element for removably attaching said pulley assembly to said pulley assembly attaching element; and,
ii) a pulley housing attached to said support assembly attachment element for supporting a cable assembly;
d) a cable assembly, comprising:
i) a pair of cables, each operatively associated with said pulley housing; and,
ii) a pair of handles, each handle secured at a respective first end of one of said cables; and,
e) at least one cable anchor bracket securely attached to said vertical portion or said upper portion.

5. The shoulder stretcher assembly of claim 1 further comprising:
a) a cable assembly, comprising:
i) a pair of cables, each cable including a cable attaching element at a respective second end of each of said cables; and,
ii) a pair of handles, each handle secured at a respective first end of one of said cables; and,
b) at least one cable anchor bracket securely attached to said vertical portion or said upper portion for securing said cable attaching elements.

6. The shoulder stretcher assembly of claim 1 wherein said upper portion terminates with said pulley assembly attaching element.

7. A shoulder stretcher assembly, comprising:
a) an exercise chair having a chair frame;
b) an elongated support assembly, comprising:
i) a substantially vertical portion securely attachable to a rear portion of said chair frame of said chair; and,
ii) an upper portion projecting forwardly from said substantially vertical portion so as to extend over said chair, said upper portion including a pulley assembly attaching element for attaching a pulley assembly for supporting a cable assembly;
c) a pulley assembly, comprising:
i) a support assembly attachment element for removably attaching said pulley assembly to said pulley assembly attaching element; and,
ii) a pulley housing attached to said support assembly attachment element for supporting a cable assembly;
wherein said elongated support assembly, comprises:
a) a lower mounting bracket assembly securely attachable to a lower section of said rear portion of said chair frame for securely supporting a lower end of said substantially vertical portion; and,
b) an upper mounting bracket assembly securely attachable to an upper section of said rear portion of said chair frame for securely supporting an intermediate section of said substantially vertical portion.

8. The shoulder stretcher assembly of claim 1 wherein said elongated support assembly, comprises:

a) a lower mounting bracket assembly securely attachable to a lower section of said rear portion of said chair frame, said lower section comprising a horizontal crossbar connecting two rear legs of a chair, said lower mounting bracket assembly, comprising:

i) a lower mounting bracket having an opening for accepting and for securely supporting a lower end of said substantially vertical portion; and, ii) a bottom plate for matingly engaging said lower mounting bracket for securing said lower mounting bracket assembly to said horizontal crossbar; and, b) an upper mounting bracket assembly securely attachable to an upper section of said rear portion of said chair frame, said upper mounting bracket assembly for securely supporting an intermediate section of said substantially vertical portion, said upper section comprising a center column near the top of a backrest of the chair, said upper mounting bracket assembly, comprising:

i) an upper mounting bracket having an opening for accepting and for securely supporting said intermediate section of said substantially vertical portion; and, ii) an upper bracket plate for matingly engaging said upper mounting bracket for securing said upper mounting bracket assembly to said center column.

9. A shoulder stretcher assembly, comprising:

a) an exercise chair having a chair frame;

b) an elongated support assembly, comprising:

i) a substantially vertical portion securely attachable to a rear portion of said chair frame of said chair; and, ii) an upper portion projecting forwardly from said substantially vertical portion so as to extend over said chair, said upper portion including a Pulley assembly attaching element for attaching a pulley assembly for supporting a cable assembly;

c) a pulley assembly, comprising:

i) a support assembly attachment element for removably attaching said pulley assembly to said pulley assembly attaching element; and, ii) a pulley housing attached to said support assembly attachment element for supporting a cable assembly;

wherein said elongated support assembly, comprises:

a) a lower straight support tube, comprising a main section of said substantially vertical portion;

b) an upper support tube, having a straight lower part thereof and a curved upper part thereof, said straight lower part comprising another section of said substantially vertical portion, and said curved upper part comprising said upper portion of said elongated support assembly; and, c) a tube connector bar for coupling said lower straight tube with said upper support tube.

10. The shoulder stretcher assembly of claim 1 wherein said elongated support assembly, comprises:

a) a lower straight support tube, comprising a main section of said substantially vertical portion;

b) an upper support tube, having a straight lower part thereof and a curved upper part thereof, said straight lower part comprising another section of said substantially vertical portion, and said curved upper part comprising said upper portion of said elongated support assembly; and, c) a tube connector bar for coupling said lower straight tube with said upper support tube, said tube connector bar having a central spacing ridge for spacing said lower straight support tube from said upper support tube and allowing relative rotation therebetween.

11. The shoulder stretcher assembly of claim 1 wherein said support assembly attachment element and said pulley housing comprise an integral unit, an opening provided in said support assembly attachment element for providing access to said pulley assembly attaching element, said pulley housing, comprising:

i) a pulley bracket integrally attached to said pulley assembly attaching element; and, ii) a pair of pulleys attached to swivel in an orthogonal direction from a plane of said pulley bracket.

12. The shoulder stretcher assembly of claim 1 wherein a) said pulley assembly attaching element comprises a sleeve for fitting over an end of said elongated support assembly and, b) said pulley housing, comprising:

i) a pulley bracket integrally attached to said pulley assembly attaching element; and, ii) a pair of pulleys attached to swivel in an orthogonal direction from a plane of said pulley bracket.

13. The shoulder stretcher assembly of claim 1 wherein said pulley assembly, comprises a cable/pulley assembly, comprising:

a cable assembly, comprising:

i) a cable operatively associated with said pulley housing; and, ii) a pair of handles, each handle secured at a respective end of said cable.

* * * * *